United States Patent [19]

Jorgensen

[11] 3,960,202

[45] June 1, 1976

[54] FOUNDRY EQUIPMENT

[75] Inventor: Hemming Kristian Jorgensen, Klampenborg, Denmark

[73] Assignee: Dansk Industri Syndikat A/S, Herlev, Denmark

[22] Filed: June 11, 1974

[21] Appl. No.: 478,254

[30] Foreign Application Priority Data

June 19, 1973 Denmark ..... 3383/73

[52] U.S. Cl. ..... 164/325; 249/137

[51] Int. Cl.[2] ..... B22C 17/08

[58] Field of Search ..... 249/137, 139; 425/453; 164/322, 323, 409, 324, 325; 198/211; 214/1 Q

[56] References Cited

UNITED STATES PATENTS

| | | | |
|---|---|---|---|
| 780,973 | 1/1905 | Campbell | 164/325 X |
| 1,589,365 | 6/1926 | Chesterfield | 249/139 X |
| 1,911,106 | 5/1933 | Camerota | 164/404 |
| 2,317,574 | 4/1943 | Williams | 164/325 |
| 2,546,517 | 3/1951 | Norman | 164/324 X |
| 2,667,674 | 2/1954 | Hines | 198/211 X |
| 2,762,094 | 9/1956 | Vieth | 164/325 X |
| 2,784,859 | 3/1957 | Brownlee et al. | 198/211 X |
| 3,759,366 | 9/1973 | Adank | 214/1 Q X |

*Primary Examiner*—Francis S. Husar
*Assistant Examiner*—David S. Safran
*Attorney, Agent, or Firm*—Imirie, Smiley & Linn

[57] ABSTRACT

A foundry equipment comprises at least one guiding track element on which a number of identical mould parts are successively piled together in a position in which their greatest dimension is horizontal. After the formation of the mould, the guiding track element with the mould thereon is tilted about 90° around a horizontal axis that is parallel to the longitudinal direction of the mould, thus bringing the mould into a position in which it is ready for the pouring operation.

3 Claims, 3 Drawing Figures

FOUNDRY EQUIPMENT

BACKGROUND OF THE INVENTION

The invention relates to foundry equipment of the kind comprising a guiding track for supporting a mould consisting of uniform mould parts, which are piled closely together and present at least one pouring cavity at each joint in the mould.

Such equipment is known in which the mould parts are produced successively from foundry sand which in a chamber is compressed between a pair of opposed plates carrying semi-patterns corresponding to the castings to be produced. After the compression or pressing operation, one of the plates is operative to displace the mould part out onto the guiding track which is aligned with the chamber and on which the mould part joins the row of earlier produced mould parts which simultaneously are advanced one step on the guiding track. As required, one or more cores may be placed in the open pouring cavity in the mould part added last.

It is a matter of course that with such equipment the size of the castings that can be produced depends on the cross-sectional dimensions of the chamber in which the mould parts are produced. In practice, the width of this chamber is somewhat larger than its height, and when castings are produced having a height which exceeds the height of the chamber, but is smaller than its width, there is often a possibility of producing the castings in a position where the largest dimension is horizontal. This applies, for example, to radiator elements. However, in this case extra measures must often be taken to safeguard the cores used against bending and breakage due to the buoyancy during the pouring operation. Such a safeguard can be achieved by chaplets being placed manually in connection with the insertion of the cores, but of course it must be preferred to avoid such an operation that enhances the costs and is time-consuming.

SUMMARY OF THE INVENTION

This is possible with the foundry equipment according to the invention, in which the guiding track or at least part of the latter is tiltable around a horizontal axis, which is parallel to the longitudinal direction of the casting mould, so as to be movable between a position for receiving the mould parts and a pouring position, in which the mould has been turned about 90°.

In this case the mould can be produced with cavities, the largest dimension of which is horizontal and at right angles to the longitudinal direction of the mould, but after a mould consisting of a suitable number of mould parts has been finished, this mould can be tilted or revolved into a position in which the cavities are vertical, that is to say have their largest dimension in the vertical direction, so that no manually placed chaplets or other special measures are needed for securing the cores in the correct position in the pouring cavity, thus involving a considerable economy as regards time and wages. According to the invention it is preferred that the guiding track of the equipment comprises four guiding track elements which are built together in a revolving frame with horizontal axis and which, in a section at right angles to the axis, lie like the arms of a cross with its center in the axis, the revolving frame being connected to a drive mechanism intended for imparting to the revolving frame an intermittent, one-way turning movement with stop positions, in which the guiding track elements are successively in the receiving position, as well as a reciprocating displacement for connection to and disconnection from the associated mould part producing apparatus.

While the revolving frame is stationary, a mould with cores can be produced in the ordinary way on one of the four guiding track elements. By a axial displacement of the revolving frame the mould thus formed can be pulled clear of the mould part which during the next operation would have been transferred onto the guiding track element. Subsequently, the revolving frame is turned 90° whereby the mould formed is brought into its pouring position while at the same time the next, empty guiding track element is brought into the receiving position. The pouring into the finished mould can then be performed simultaneously with the production of the next mould after the revolving frame has moved axially back into its starting position. By an additional turning of 90°, casting mould No. 2 is brought into its pouring position, while casting mould No. 1 with the metal poured into it is turned forwards into a position of rest in which a certain degree of cooling takes place. At the ensuing turning movement, casting mould No. 1 with the castings, which have by now solidified, can drop onto a conveyor and be led to a place for further treatment.

An embodiment of the foundry equipment according to the invention will now be more fully described with reference to the accompanying diagrammatical drawings.

DESCRIPTION OF THE PREFERRED EMBODIMENT

Figure 1:
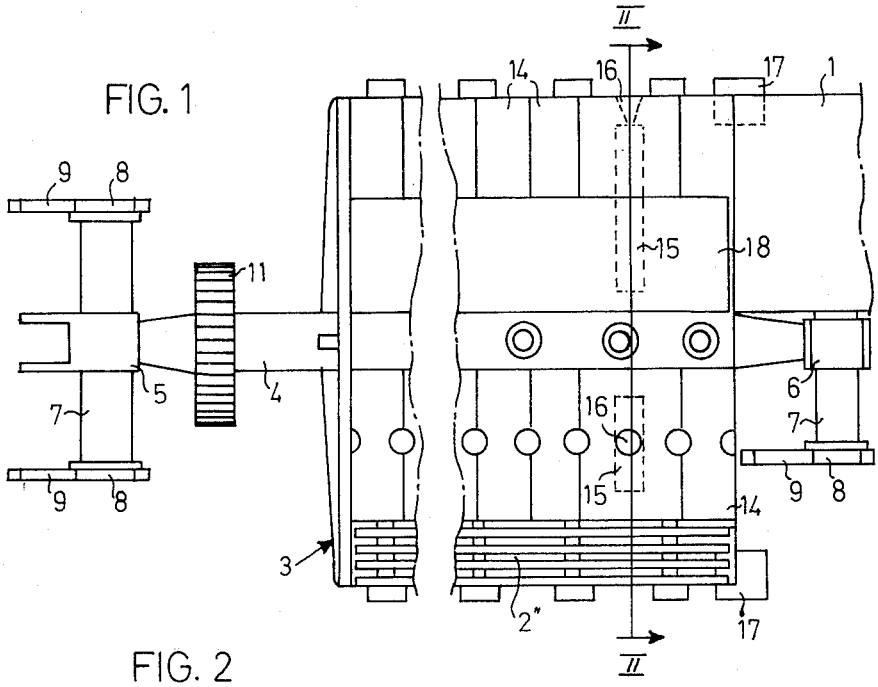
FIG. 1 is a plan view of the equipment according to the present invention.
Figure 2:
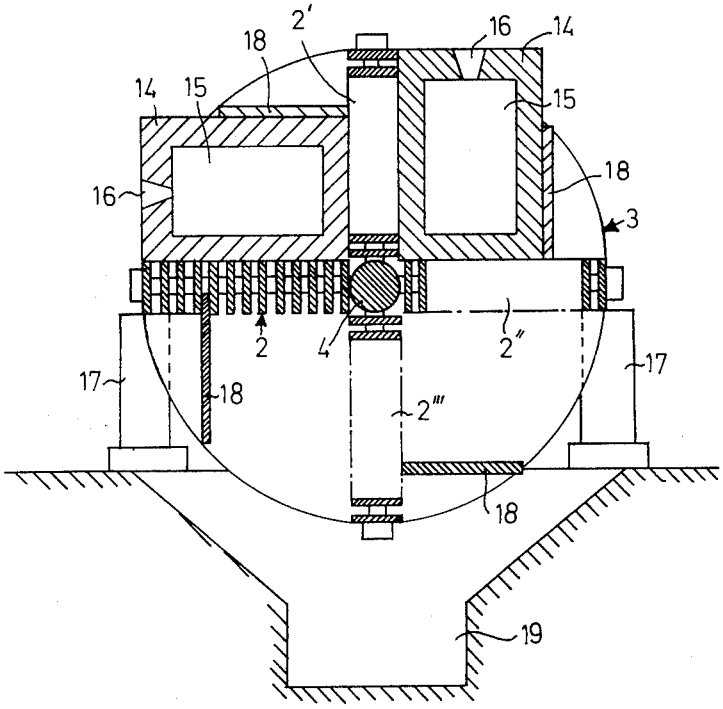
FIG. 2 is a cross-sectional view on line II-II in FIG. 1.
Figure 3:
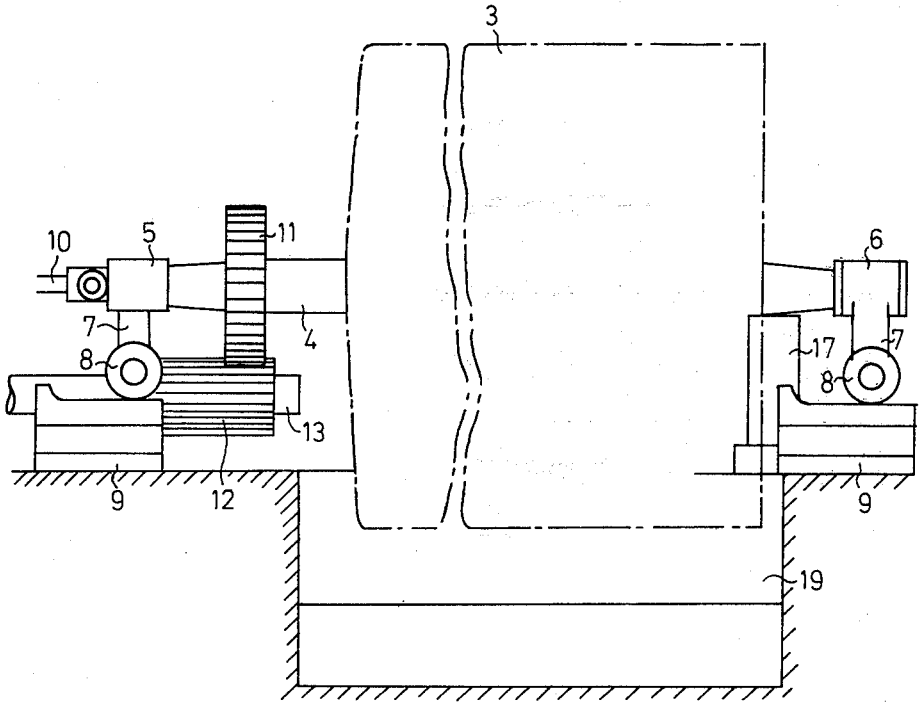
FIG. 3 is an elevational view corresponding to FIG. 1.

FIG. 1 shows the end portion 1 of a stationary guiding track associated with a mould part producing apparatus, not shown. Aligned with this track, a grate-shaped guiding track element 2, FIG. 2, is provided which together with three similar guiding track elements are incorporated in a revolving frame 3 with a central supporting shaft 4 which at its ends is supported in bearings 5 and 6. Each of the said bearings 5 and 6 is carried by a cross-bar 7 which at its ends has wheels 8 running on short rails 9. The force necessary for this purpose can be transmitted to the bearing 5 via a pull- and pressure-rod 10 associated with a hydraulic cylinder, not shown.

The shaft 4 also carries a gear wheel 11 fixed to the shaft and engaging an elongated gear wheel 12 mounted on a shaft 13, to which, by means of an electromotor, not shown, with a suitable gearing an intermittent clockwise rotation can be imparted, FIG. 2.

In the situation shown in the drawing, the revolving frame 3 is in its right-hand extreme position, so that the guiding track element 2 forms a direct continuation of the guiding track 1. A number of mould parts 14 have been pushed from the guiding track 1 onto the guiding track element 2 so as to form a mould, for example for the production of radiator elements. The cavity 15 of the mould with the associated gate 16 are only shown purely diagrammatically. With the revolving frame in the position stated the guiding track element 2 as well as the oppositely located and likewise horizontal guiding track element 2'' rest on a pair of supports 17 which secure the revolving frame and fix the latter accurately in the correct position.

After the mould has been built up on the guiding track element 2, the revolving frame 3 is displaced to the left, whereby the two guiding track elements 2 and 2'' with the clear of the supports 17. Next, a clockwise turning of 90°, FIG. 2, is imparted to the frame 3 with the casting mould formed, whereby the guiding track element 2 with the casting mould arrives at the position shown by 2' in FIG. 2. The gates 16 for the mould cavities 15 now face upwards, and, in other words, the mould is in its pouring position. During the pouring operation a new casting mould can be produced on the guiding track element 2''', which has now been brought into a horizontal position aligned with the guiding track 1.

By a subsequent turning movement the mould with the castings therein is carried into a cooling position in the lower, right-hand quadrant in FIG. 2 in which the mould is supported on a holding plate 18 incorporated in the revolving frame, while a certain cooling of the castings occurs. Not until the ensuing turning of 90° will the mould with the castings drop out of the revolving frame and onto a conveyor, not shown, in the bottom of a pit 19 under the revolving frame.

What is claimed is:

1. In a casting apparatus handling casting molds consisting of a plurality of uniform mold parts which are piled closely together to form a horizontal series presenting at least one casting cavity at each joint between successive mold parts, the improvement comprising: a frame that is journalled for rotation around a horizontal axis and includes at least two rigidly interconnected mold supports extending parallel to said axis and regularly angularly spaced around the same, means to stepwise and unidirectionally rotate said frame so as to tiltably move each of said mold supports successively through a substantially horizontal mold receiving position, a substantially vertical pouring position, and a mold discharge position, and means to hold a mold firmly against each of said supports during the tilting thereof until said mold discharge position has been reached.

2. An apparatus as claimed in claim 1, wherein said frame includes four mold supports forming together a rigid structure having a cruciform transverse section and presenting a mold receiving space in each of its four quadrants.

3. An apparatus as claimed in claim 1, wherein said frame is axially reciprocable between a first position in which it is free to rotate, and a second position in which the frame at one end thereof rests on firm supports spaced radially from said axis.

* * * * *